US008272760B2

(12) United States Patent
Zheng

(10) Patent No.: US 8,272,760 B2
(45) Date of Patent: Sep. 25, 2012

(54) WATERPROOF LED DISPLAY

(76) Inventor: Zhongliang Zheng, Hangzhou (CN)

( * ) Notice: Subject to any disclaimer, the term of this patent is extended or adjusted under 35 U.S.C. 154(b) by 340 days.

(21) Appl. No.: 12/625,183

(22) Filed: Nov. 24, 2009

(65) Prior Publication Data

US 2011/0122620 A1 May 26, 2011

(51) Int. Cl.
*F21S 4/00* (2006.01)

(52) U.S. Cl. ..... 362/249.02; 362/217.01; 362/217.1; 362/219; 362/225; 362/249.01; 362/632; 362/633

(58) Field of Classification Search ..... 362/217.01, 362/217.1, 219, 225, 249.01, 249.02, 632–634; 439/271, 272, 277; 349/58
See application file for complete search history.

*Primary Examiner* — Stephen F Husar
*Assistant Examiner* — Meghan Dunwiddie

(57) ABSTRACT

A LED display includes at least two standard LED units connected side by side, having a peripheral hole and wire passing hole, a wire passing hole stopper, comprising a first annular seat, fixed around the wire passing hole via a first double sided adhesive, a first silicon rubber sealing ring, and a first screw, provided on one side of the wire passing hole; a second annular seat, fixed around the wire passing hole via a second double sided adhesive, a second silicon rubber sealing ring, and a second screw, provided on the other side of the wire passing hole, and a peripheral hole stopper comprising a third annular seat, fixed around the peripheral hole via a third double sided adhesive, a peripheral hole cap, and an O-shaped sealing ring provided between the third annular seats and the peripheral hole cap.

8 Claims, 3 Drawing Sheets

WATERPROOF LED DISPLAY

BACKGROUND OF THE PRESENT INVENTION

1. Field of Invention

The present invention relates to a LED display formed by a plurality of standard LED units, and more particularly to a waterproof LED display formed by a plurality of standard LED units.

2. Description of Related Arts

LED displays are widely used in various situations, such as stadiums, malls, airports, casinos, and stages. LED displays of different sizes are needed for different situations. However, producing LED displays of different sizes is very troublesome. Therefore, LED display formed by a plurality of standard LED units has been developed. How to effectively and efficiently connect the standard LED units to form a larger LED display becomes a difficult problem.

Because the standard LED units need to be connected side by side, each standard LED unit has a plurality holes on the periphery walls. Thus, when the standard LED units are connected side by side, power wires and signal wires can pass through holes between the connected standard LED units. LED display is mainly used in outdoors, so that the LED display must be waterproof, which means the peripheral hole and wire passing hole has to be waterproof during the usage.

The traditional waterproof design has drawbacks. For example, the wire passing hole is sealed by silica gel. The silica gel is not easy to be pressed tightly, which will lead to leakage. The peripheral hole is sealed by sheetmetal and silica gel ring, which is very heavy and inconvenient to install. Therefore, the traditional water-proof design needs to be improved.

SUMMARY OF THE PRESENT INVENTION

An object of the present invention is to provide a LED display formed by a plurality of standard LED units, having a peripheral hole on a peripheral wall of the LED display and wire passing hole between the neighboring standard LED units, comprising a wire passing hole stopper and a peripheral hole stopper to make the LED display to be waterproof.

Accordingly, in order to accomplish the above object, the present invention provides a LED display comprising:

at least two standard LED units connected side by side, having a peripheral hole on a peripheral wall of the LED display and wire passing hole between the neighboring standard LED units for wires passing through, a wire passing hole stopper, adapted for sealing the wire passing hole, comprising a first annular seat, having a T-shaped cross section, provided on one side of the wire passing hole and fixed around the wire passing hole via a first double sided adhesive; a first screw, mounted onto the first annular seat, having a through hole for wires passing through and having a threaded stem; a first silicon rubber sealing ring, provided between the first annular seat and the first screw; a second annular seat, having a T-shaped cross section, provided on the other side of the wire passing hole and fixed around the wire passing hole via a second double sided adhesive, a second screw, mounted onto the second annular seat, having a through hole for wires passing through and having an inner threaded surface for fixedly receiving the first screw; a second silicon rubber sealing ring, provided between the second annular seat and the second screw, and a peripheral hole stopper comprising a third annular seat, having a T-shaped cross section, fixed around the peripheral hole via a third double sided adhesive and having an inner threaded surface; a peripheral hole cap having an outer threaded surface for being inserted into the third annular seat; an O-shaped sealing ring provided between the third annular seats and the peripheral hole cap.

These and other objectives, features, and advantages of the present invention will become apparent from the following detailed description, the accompanying drawings, and the appended claims.

DETAILED DESCRIPTION OF THE PREFERRED EMBODIMENT

Figure 1:
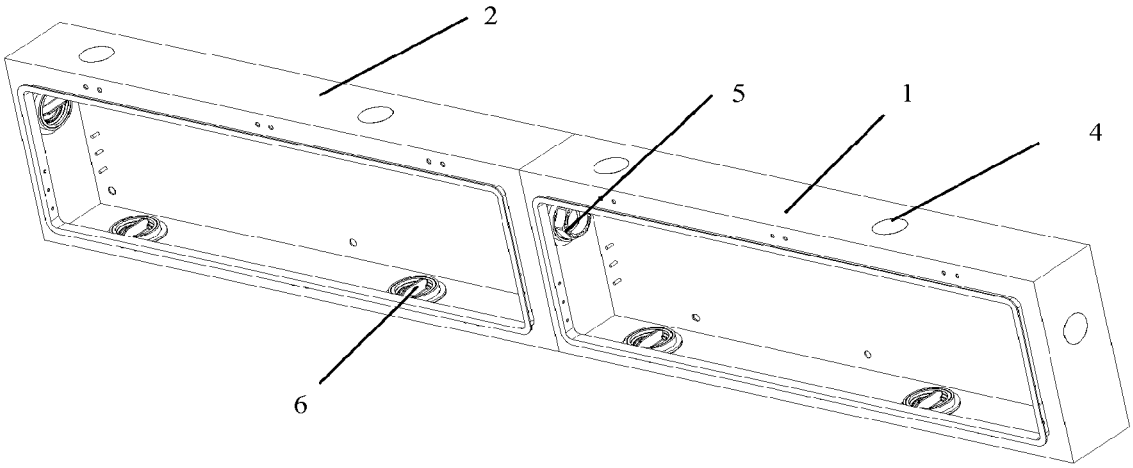
FIG. 1 is a perspective view of a LED display formed by two standard LED units according to a preferred embodiment of the present invention.
Figure 2:
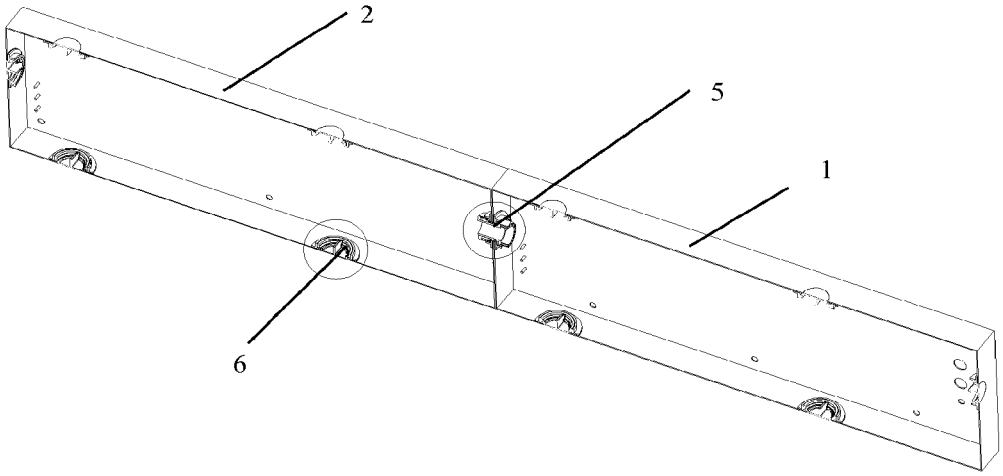
FIG. 2 is a sectional view of a LED display formed by two standard LED units according to the above preferred embodiment of the present invention.

Referring to FIG. 1 and FIG. 2 of the drawings, a LED display formed by two standard LED units is taken as an example in the preferred embodiment. A wire passing hole 3 is positioned between a first standard LED unit 1 and a second standard LED unit 2, and a peripheral hole 4 is positioned on a peripheral wall of the standard LED unit. The first and second standard LED units are connected to form a LED display.

In order to be waterproof, the LED display of the present invention further comprises a wire passing hole stopper 5 and a peripheral hole stopper 6 to mount onto the wire passing hole 3 and the peripheral hole 4.

Figure 3:
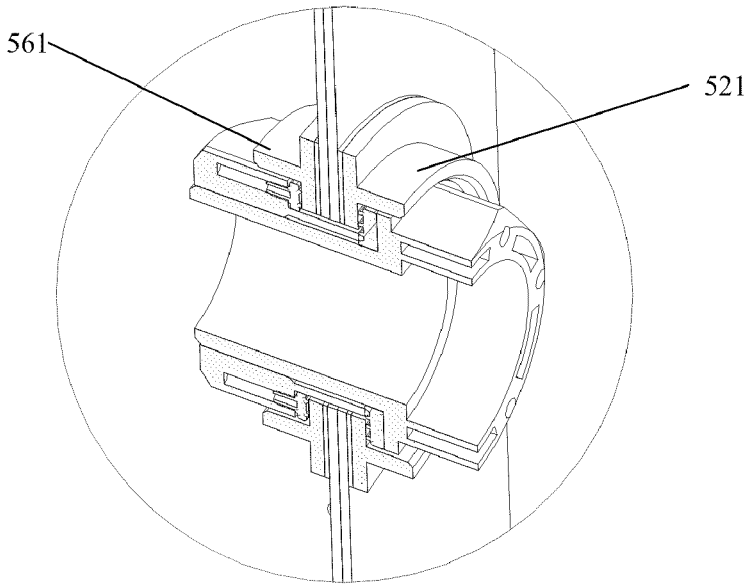
FIG. 3 is a sectional view of a wire passing hole stopper according to the above preferred embodiment of the present invention.
Figure 5:
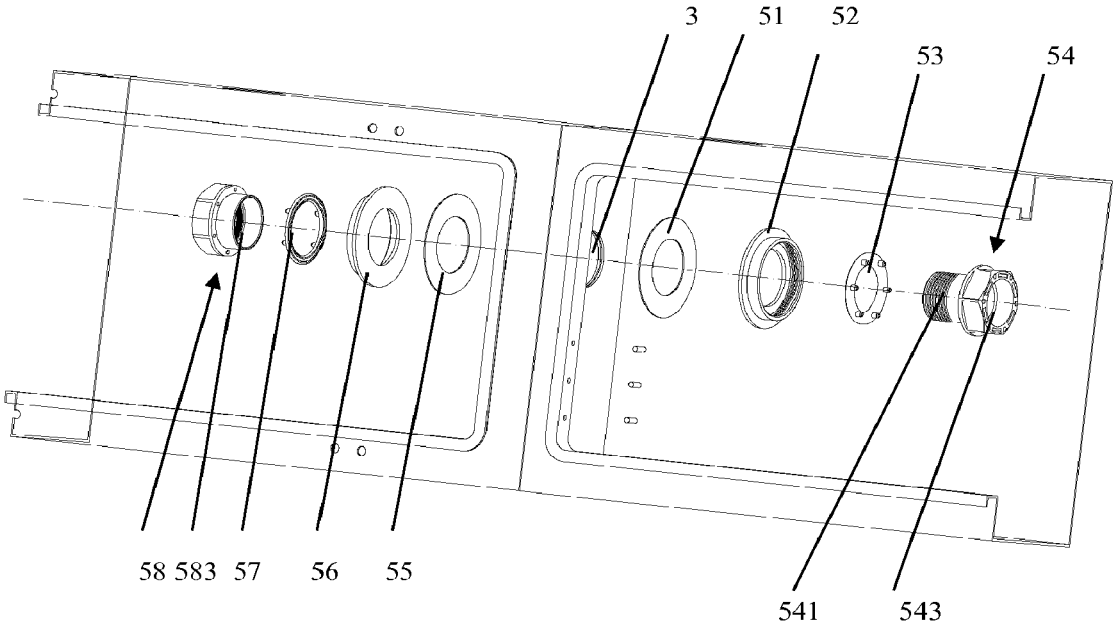
FIG. 5 is an exploded view of a wire passing hole stopper according to the above preferred embodiment of the present invention.

As shown in FIG. 3 and FIG. 5, the wire passing hole stopper 5 comprises a first annular seat 52, having a T-shaped cross section, provided on one side of the wire passing hole and fixed around the wire passing hole via a first double sided adhesive 51; a first screw 54, mounted onto the first annular seat 52, having a first through hole 543 for wires passing through and having a threaded stem 541; a first silicon rubber sealing ring 53, provided between the first annular seat and the first screw; a second annular seat 56, having a T-shaped cross section, provided on the other side of the wire passing hole and fixed around the wire passing hole via a second double sided adhesive 55, a second screw 58, mounted onto the second annular seat 56, having a second through hole 583 for wires passing through and having an inner threaded surface for fixedly receiving the first screw 54; a second silicon rubber sealing ring 57, provided between the second annular seat 56 and the second screw 58.

The first double sided adhesive 51, the first annular seat 52, the first silicon rubber sealing ring 53, the second double sided adhesive 55, the second annular seat 56, and the second silicon rubber sealing ring 57 has a same inner diameter with the wire passing hole 3 for the stem 541 of the first screw 54 passing through to be fixed with the second screw 58. The first annular seat 52 has a round projection 521 between the inner peripheral wall and the outer peripheral wall so as to form a T-shaped cross section. The first silicon rubber sealing ring 53 is provided at an inner side of the round projection 521 of the first annular seat 52. The second annular seat 56 has a round projection 561 between the inner peripheral wall and the outer peripheral wall so as to form a T-shaped cross section. The second silicon rubber sealing ring 57 is provided at an inner side of the round projection 561 of the second annular seat 56.

The first annular seat 52 and the second annular seat are made of plastic, so that the weight is light and structure is stable.

Figure 4:
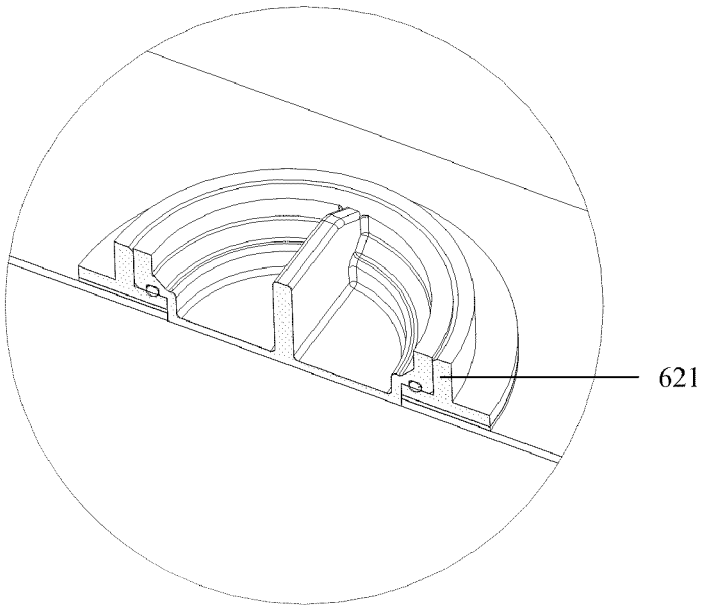
FIG. 4 is a sectional view of a peripheral hole stopper according to the above preferred embodiment of the present invention.
Figure 6:
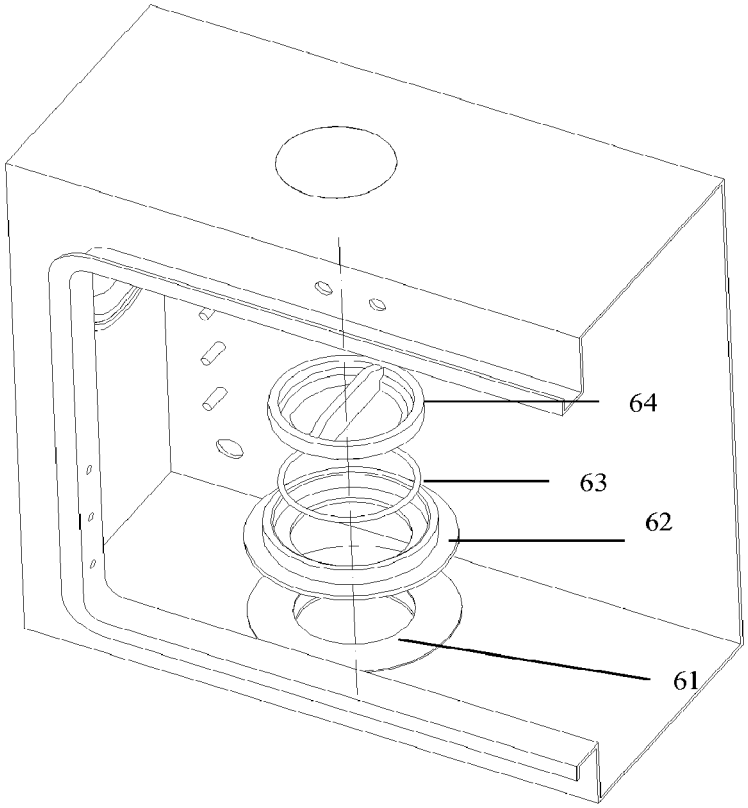
FIG. 6 is a exploded view of a peripheral hole stopper according to the above preferred embodiment of the present invention.

As shown in FIG. 4 and FIG. 6, a peripheral hole stopper 6 comprises a third annular seat 62, having a T-shaped cross section, fixed around the peripheral hole via a third double sided adhesive 61 and having an inner threaded surface; a peripheral hole cap 64 having an outer threaded surface for being inserted into the inner threaded surface of third annular seat 62; an O-shaped sealing ring 63 provided between the third annular seats 62 and the peripheral hole cap 64.

The third annular seat 62 has a round projection 621 between the inner peripheral wall and the outer peripheral wall so as to form a T-shaped cross section. The O-shaped sealing ring 63 is provided at an inner side of the round projection 621 of the third annular seat 62.

The third annular ring 62 and the peripheral hole cap 64 are made of plastic, so that the weigh is light and structure is stable.

It is worth mentioning that the periphery hole stopper is used for the periphery hole of the standard LED unit. When two standard LED units are connected, two periphery holes on the contact walls of the standard LED units becomes wire passing hole. Detach the peripheral hole cap 64 with O-shaped sealing ring 63 and insert the first screw 54 and the second screw 58 into the first annular seat and the second annular seat from both sides of the wire passing hole respectively to proof water for the wire passing hole.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED display, comprising:

at least two standard LED units connected side by side, having a peripheral hole on a peripheral wall of the LED display and wire passing hole between the neighboring standard LED units for wires passing through, a wire passing hole stopper, adapted for sealing the wire passing hole, comprising a first annular seat, having a T-shaped cross section, provided on one side of the wire passing hole and fixed around the wire passing hole via a first double sided adhesive; a first screw, mounted onto the first annular seat, having a through hole for wires passing through and having a threaded stem; a first silicon rubber sealing ring, provided between the first annular seat and the first screw; a second annular seat, having a T-shaped cross section, provided on the other side of the wire passing hole and fixed around the wire passing hole via a second double sided adhesive, a second screw, mounted onto the second annular seat, having a through hole for wires passing through and having an inner threaded surface for fixedly receiving the first screw; a second silicon rubber sealing ring, provided between the second annular seat and the second screw, and a peripheral hole stopper comprising a third annular seat, having a T-shaped cross section, fixed around the peripheral hole via a third double sided adhesive and having an inner threaded surface; a peripheral hole cap having an outer threaded surface for being inserted into the third annular seat; an O-shaped sealing ring provided between the third annular seats and the peripheral hole cap.

2. The LED display, as recited in claim 1, wherein the first double sided adhesive, the first annular seat, the first silicon rubber sealing ring, the second double sided adhesive, the second annular seat, and the second silicon rubber sealing ring has a same inner diameter with the wire passing hole for the stem of the first screw passing through to be fixed with the second screw.

3. The LED display, as recited in claim 1, wherein the third annular seat and peripheral hole cap are made of plastic.

4. The LED display, as recited in claim 2, wherein the third annular seat and peripheral hole cap are made of plastic.

5. A wire passing hole stopper, used for sealing a wire passing hole between two neighbouring standard LED units of a LED display, comprising a first annular seat, having a T-shaped cross section, provided on one side of the wire passing hole and fixed around the wire passing hole via a first double sided adhesive; a first screw, mounted onto the first annular seat, having a through hole for wires passing through and having a threaded stem; a first silicon rubber sealing ring, provided between the first annular seat and the first screw; a second annular seat, having a T-shaped cross section, provided on the other side of the wire passing hole and fixed around the wire passing hole via a second double sided adhesive, a second screw, mounted onto the second annular seat, having a through hole for wires passing through and having an inner threaded surface for fixedly receiving the first screw; a second silicon rubber sealing ring, provided between the second annular seat and the second screw.

6. The wire passing hole stopper, as recited in claim 5, wherein the first double sided adhesive, the first annular seat, the first silicon rubber sealing ring, the second double sided adhesive, the second annular seat, and the second silicon rubber sealing ring has a same inner diameter with the wire passing hole for the stem of the first screw passing through to be fixed with the second screw.

7. A peripheral hole stopper, used for a peripheral hole on a peripheral wall of a LED display, comprising an annular seat, having a T-shaped cross section, fixed around the peripheral hole via a double sided adhesive and having an inner threaded surface; a peripheral hole cap having an outer threaded surface for being inserted into the annular seat; an O-shaped sealing ring provided between the annular seats and the peripheral hole cap.

8. The peripheral hole stopper, as recited in claim 7, wherein the annular seat and peripheral hole cap are made of plastic.

* * * * *